United States Patent [19]

Green

[11] 4,328,110

[45] May 4, 1982

[54] FABRIC CONDITIONING ARTICLES AND METHODS OF USE

[75] Inventor: Donald L. Green, Forest Lakes, N.J.

[73] Assignee: Beecham Inc., Clifton, N.J.

[21] Appl. No.: 188,067

[22] Filed: Sep. 17, 1980

[51] Int. Cl.[3] ..... D06M 13/46; D06M 13/30

[52] U.S. Cl. ..... 252/8.75; 252/8.8; 252/8.6

[58] Field of Search ..... 252/8.6, 8.8, 8.75; 427/242

[56] References Cited

U.S. PATENT DOCUMENTS

| | | | |
|---|---|---|---|
| 3,442,692 | 6/1969 | Gaiser | 427/242 |
| 3,622,538 | 11/1969 | Green | 260/45.7 PH |
| 3,634,947 | 1/1972 | Furgal | 252/8.9 |
| 3,676,199 | 7/1972 | Hewitt et al. | 427/242 |
| 3,686,025 | 8/1972 | Morton | 427/242 |
| 3,698,095 | 10/1972 | Grand et al. | 427/242 |
| 3,766,062 | 10/1973 | Wixon | 252/534 |
| 3,785,973 | 1/1974 | Bernholz | 252/8.8 |
| 3,936,538 | 2/1976 | Marshall et al. | 427/242 |
| 3,972,131 | 8/1976 | Rudy et al. | 427/242 |
| 3,977,980 | 8/1976 | Fry et al. | 427/242 |
| 4,012,326 | 3/1977 | Rudy et al. | 427/242 |
| 4,022,938 | 5/1977 | Zaki et al. | 427/242 |
| 4,041,205 | 8/1977 | Compa et al. | 427/242 |
| 4,121,009 | 10/1978 | Chakrabarti | 427/242 |
| 4,126,561 | 11/1978 | Barker | 427/240 |
| 4,126,563 | 11/1978 | Barker | 427/240 |
| 4,238,531 | 12/1980 | Rudy et al. | 252/8.8 |

*Primary Examiner*—Maria Parrish Tungol

*Attorney, Agent, or Firm*—Jacobs & Jacobs

[57] ABSTRACT

A substrateless dryer-added fabric conditioning product is produced which comprises a fabric conditioning amount of a fabric conditioning agent in tablet form.

28 Claims, No Drawings

FABRIC CONDITIONING ARTICLES AND METHODS OF USE

The present invention relates to a substrateless fabric conditioning agent which is particularly useful for conditioning fabrics during the drying cycle of an automatic laundry dryer.

It is known in the art that fabrics may be commingled with softening compositions containing cationic fabric softeners to provide a soft, antistatic finish to the fabrics during the course of the drying operation.

"Fabric softness" is an expression known in the art and is customarily understood to be that quality of the treated fabric which is characterized by smoothness, pliability and a "soft hand."

U.S. Pat. No. 3,634,947 discloses fatty alkyl cationic fabric softeners which also reduce static cling and discloses compositions and methods for applying such compounds to fabrics in an automatic dryer. U.S. Pat. Nos. 3,686,025 and 3,442,692 have similar disclosures.

U.S. Pat. No. 3,785,973 discloses triglyceride agents as fabric softeners.

U.S. Pat. No. 3,676,199 and U.S. Pat. No. 3,766,062 disclose that many of the prior art softening agents stain or discolor the fabrics during the course of the drying cycle and this tendency is apparently the result of the fatty alkyl groups in the fabric softening compounds. Also, if the fabric softeners are distributed unevenly, there may be blotchy oily stains on the fabric and this may give rise to an oily feel to the fabric which has been treated.

U.S. Pat. No. 3,622,538 and U.S. Pat. No. 3,698,095 disclose various methods for reducing the tendency of fabric softeners to stain during the drying cycle.

U.S. Pat. No. 4,022,938 describes a fabric softening and antistatic composition which comprises a major amount of a conventional cationic fabric softening material and minor amount of a sorbitan ester component as a fabric softening agent and release aid. It is stated that such compositions provide a synergistic fabric softening effect and an antistatic effect whem employed in the dryer. It is disclosed that it is essential to the operation of a fabric softener and static reducing agent that it melt and flow at dryer operating temperatures which are generally in the range of 50° C. to 100° C. thereby providing for transfer of the softening composition to the fabrics. The sorbitan esters are suggested as being useful in lowering the melting point of the cationic fabric softeners to within the optimum dryer operating temperature range.

While U.S. Pat. No. 3,686,025 was the first patent to appreciate the importance of controlling the release of conditioning agent from the substrate, the patent achieved its goal by controlling the absorbency of the material used as a substrate. According to that patent, an absorbent capacity of 5.5 to 12, preferably 7 to 10 was the criterion for selecting a substrate and absorbencies or absorbent capacities in excess of 12 were to be avoided as undesirable.

U.S. Pat. No. 3,977,980 describes a solid dryer-added fabric conditioner which comprises a mixture of a fabric-conditioning agent and diatomaceous earth in a compressed form. This patent specifies that the product is in the form of a briquette and specifically states that a tabletted form of the product was attempted but that no breakup was observed when the tabletted form was placed in the dryer.

U.S. Pat. No. 3,936,538 describes a fabric softening composition to be added to the dryer which consists of a film-forming polymer, softening agent, and a waxy surfactant.

U.S. Pat. No. 4,012,326 describes a method for applying a fabric conditioning agent to fabrics in the dryer whereby the fabric conditioning agent is diluted with a suitable diluent which is spreadable under conditions encountered in the dryer. Among the forms of the product are powders, chips, granules and flakes.

U.S. Pat. No. 4,041,205 describes a fabric conditioning article for use in the dryer which comprises at least one fabric conditioning and a reinforcing, strengthening or extending material. The reinforcing materials are small fibers, particles, natural or synthetic gums or binders. The preferred form of the article is a sheet or strip.

More particularly, the instant invention involves a substrateless product in tablet form useful for conditioning fabrics during the drying cycle of an automatic laundry dryer. The product comprises a fabric conditioning amount of a fabric conditioning agent, a suitable filler, a tablet binder/disintegrant material, and a lubricant to facilitate tabletting the mixture.

The present invention also comprises a method of conditioning fabrics during the drying cycle of an automatic laundry dryer. The method comprises adding a substrateless fabric conditioning article, according to the present invention, to damp fabrics in an automatic clothes dryer and operating the dryer in standard fashion. Upon completion of the drying cycle softening and antistatic benefits have been supplied to the fabrics. The particular advantage of the product of the present invention is that upon removal of the fabrics from the laundry dryer, there remains no product substrate to be separated from the fabrics as is the case with most of the prior art. In addition, the size of the product according to the present invention makes it more convenient to store and to handle.

According to the present invention, the fabric conditioning agent may be any fabric conditioning agent which can be powdered or granulated and which has a softening point within the temperature range normally encountered in an automatic laundry dryer.

Such fabric conditioning agent is preferably a fabric softening and/or antistatic agent which is selected from the following classes of compounds which contain at least one long chain group:

(1) cationic quaternary ammonium salts including quaternary imidazolinium salts;
(2) nonionic compounds, such as tertiary phosphine oxides, tertiary amine oxides and ethoxylated alcohols and alkylphenols;
(3) anionic soaps, sulfates and sulfonates e.g., fatty acid soaps, ethoxylated alcohol sulfates and sodium alkyl sulfates, alkyl sulfonates, sodium alkylbenzene sulfonates, and sodium or potassium alkylglycerylethersulfonates;
(4) zwitterionic quaternary ammonium compounds;
(5) ampholytic tertiary ammonium compounds; and
(6) compatible mixtures of one or more compounds of these classes.

The fabric conditioning agent may also be a mixture of a fabric softening and/or antistatic agent such as a quaternary ammonium compound, and a nonionic melting point depressant which lowers the softening point of the mixture to within the range normally encountered in an automatic laundry dryer.

Suitable nonionic compounds include:

1. Glycerol mono- and di-stearates
2. Polyoxyethylene fatty acid esters
3. Polyoxyethylene fatty alcohol ethers
4. Polypropoxylene fatty acid esters
5. Sorbitan esters as further described in U.S. Pat. No. 4,022,938. Any compound or mixture of such compound must, of course, be able to be powdered or granulated and have a softening point within the temperature range normally encountered in an automatic laundry dryer.

Preferred softening agents are the cationic quaternary ammonium salts which have the general formula

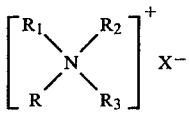

(1)

wherein X is an anion, preferably a halide, and more particularly, a chloride ion, or a methyl sulfate. Suitable other anions can include acetate, phosphate, and nitrite radicals. Additionally, in the above formula, R and $R_1$ represents benzyl or an alkyl containing from 1 to 3 carbon atoms, $R_2$ represents benzyl, or an alkyl containing from 1 to 3 carbon atoms, or an alkyl of from 12 to 20 carbon atoms, or alkoxypropyl or hydroxy substituted alkoxypropyl radicals wherein the alkoxy contains 12 to 20 carbon atoms, and $R_3$ represents an alkyl containing from 12 to 20 carbon atoms. The carbon chains of $R_3$ and $R_2$, whenever $R_2$ represents a chain of from 12 to 20 carbon atoms, can be straight or branched, and saturated or unsaturated.

Cationic softening agents known for their softening efficacy include dialkyl dimethyl ammonium or chloride trimethyl ammonium salts wherein the alkyl contains from 12 to 20 carbon atoms and are derived from long chain fatty acids, especially from hydrogenated tallow. The terms "tallow" and "tallowalkyl," used herein, are intended to mean alkyls containing from 16 to 18 carbon atoms. The term "tallowalkoxy," used herein, means an alkyl ether radical wherein the alkyl contains from 16 to 18 carbon atoms. Specific examples of the particularly preferred cationic softening agents include the following:

distearyl dimethyl ammonium methyl sulfate
tallowtrimethyl ammonium chloride,
tallowdimethyl (3-tallowalkoxypropyl) ammonium chloride,
ditallow dimethyl ammonium chloride,
ditallow dimethyl ammonium methyl sulfate,
cicosyltrimethyl ammonium chloride, and
dieicosyldimethyl ammonium chloride.

Examples of other cationic softening agents suitable for use in the invention herein include the following:

dodecyltrimethyl ammonium chloride,
didodecyldimethyl ammonium chloride,
tetradecyltrimethyl ammonium chloride,
ditetradecyldimethyl ammonium chloride,
pentadecyltrimethyl ammonium chloride,
dipentadecyldimethyl ammonium chloride,
didodecyldiethyl ammonium chloride,
didodecyldipropyl ammonium chloride,
ditetradecyldiethyl ammonium chloride,
ditetradecyldipropyl ammonium chloride,
ditallowdiethyl ammonium chloride,
ditallowdipropyl ammonium chloride,
tallowdimethyl benzyl ammonium chloride,
tallowdicthyl benzyl ammonium chloride,
dodecyltrimethyl ammonium methyl sulfate,
didodecyldicthyl ammonium acetate,
tallowtrimethyl ammonium acetate,
tallowdimethyl benzyl ammonium nitrite, and
ditallowdipropyl ammonium phosphate.

Other cationic softening agents of Formula 1 are known and include variables wherein R and $R_1$ can also represent a phenyl radical or a hydroxy substituted alkyl of from 1 to 3 carbon atoms.

Cationic quaternary imidazolinium compounds are also useful softening agents. These compounds have the formula

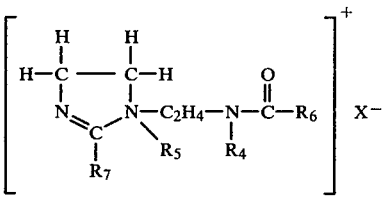

(2)

wherein $R_5$ is an alkyl containing from 1 to 4, preferably from 1 to 2, carbon atoms, $R_6$ is an alkyl containing from 1 to 4 carbon atoms or a hydrogen radical, $R_7$ is an alkyl containing from 8 to 25, preferably at least 15, carbon atoms, $R_4$ is hydrogen or an alkyl containing from 8 to 25, preferably at least 15, carbon atoms, and X is an anion, preferably methyl sulfate or chloride. Other suitable anions include those disclosed with reference to the cationic softening agents of Formula 1. Particularly preferred are those compounds of Formula 2 in which both $R_4$ and $R_7$ are alkyls of from 16 to 25, especially 16 to 18 and 20 to 22, carbon atoms.

Many other cationic quaternary ammonium softening agents, which are useful herein, are known; for example, alkyl [$C_{12}$ to $C_{20}$]-pyridinium chlorides, alkyl [$C_{12}$ to $C_{20}$]-alky [$C_1$ to $C_3$]-morpholinium chlorides, and quaternary derivatives of amino acids and amino esters.

Other softening agents include Zwitterionic quaternary ammonium compounds which have the formula

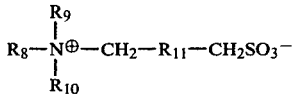

(3)

wherein $R_9$ and $R_{10}$ are each methyl, ethyl, n-propyl, isopropyl, 2-hydroxyethyl or 2-hydroxypropyl, $R_8$ is a 20 to 30 carbon atom alkyl or alkenyl and wherein said alkyl or alkenyl contains from 0 to 2 hydroxyl substituents, from 0 to 5 ether linkages, and from 0 to 1 amide linkage, and $R_{11}$ is an alkylene group containing from 1 to 4 carbon atoms with from 0 to 1 hydroxyl substituents; particularly preferred are compounds wherein $R_8$ is a carbon chain containing from 20 to 26 carbon atoms selected from the group consisting of alkyls and alkenyls and wherein said alkyls and alkenyls contain 0 to 2 hydroxyl substituents. Specific examples of compounds of this class include the following:

3-N-eicosyl-N,N-dimethylammonio)-2-hydroxypropane-1-sulfonate
3-(N-eicosyl-N,N-dimethylammonio)-propane-1-sulfonate
3-[N-eicosyl-N,N-di(2-hydroxyethyl)ammonio]-2-hydroxypropane-1-sulfonate 3-(N-docosyl-N,N-dimethylammonio)-2-hydroxypropane-1-sulfonate
3-(N-docosyl-N,N-dimethylammonio)-propane-1-sulfonate
3-[N-docosyl-N,N-bis-(2-hydroxyethyl)ammonio]-2-hydroxypropane-1-sulfonate
3-(N-tetracosyl-N,N-dimethylammonio)-2-hydroxypropane-1-sulfonate
3-(N-tetracosyl-N,N-dimethylammonio)-propane-1-sulfonate
3-[N-tetracosyl-N,N-bis-(2-hydroxyethyl)ammonio]-2-hydroxypropane-1-sulfonate 3-(N-hexacosyl-N,N-dimethylammonio)-2-hydroxypropane-1-sulfonate
3-(N-hexacosyl-N,N-dimethylammonio)-propane-1-sulfonate Examples of other preferred compounds of this class are as follows:
3-(N-eicosyl-N-ethyl-N-methylammonio)-2-hydroxypropane-1-sulfonate
3-(N-docosyl-N-ethyl-n-methylammonio)-2-hydroxypropane-1-sulfonate
3-(N-tetracosyl-N-ethyl-N-methylammonio)-2-hydroxypropane-1-sulfonate
3-(N-hencicosyl-N,N-dimethylammonio)-2-hydroxypropane-1-sulfonate
3-(N-tricosyl-N,N-dimethylammonio)-2-hydroxypropane-1-sulfonate
3-(N-tricosyl-N-ethyl-N-methylammonio)-2-hydroxypropane-1-sulfonate
3-(N-tricosyl-N,N-dimethylammonio)-propane-1-sulfonate
3-(N-pentacosyl-N,N-dimethylammonio)-2-hydroxypropane-1-sulfonate
3-[N-(2-methoxydocosyl)-N,N-dimethylammonio]-2-hydroxypropane-1-sulfonate
3-(N-heptacosyl-N,N-dimethylammonio)-propane-1-sulfonate
3-(N-octacosyl-N,N-dimethylammonio)-2-hydroxypropane-1-sulfonate
3-(N-nonacosyl-N,N-dimethylammonio)-2-hydroxypropane-1-sulfonate
3-(N-1-triacontyl-N,N-dimethylammonio)-propane-1-sulfonate
3-[N-(3,5-dioxatetracosyl)-N,N-dimethylammonio]-2-hydroxypropane-1-sulfonate Other Zwitterionic compounds useful as softening agents are known and include Zwitterionic synthetic detergents as represented by derivatives of aliphatic quaternary ammonium compounds wherein one of the four aliphatic groups has about 8 to 20 carbon atoms, another contains a water-solubilizing group (e.g., carboxy, sulfato or sulfo groups), and any of which are straight or branched (See U.S. Pat. No. 3,213,030).

Nonionic tertiary phosphine oxide compounds are also useful softening agents. These compounds have the generic formula $$R_{12}R_{13}R_{14}P\rightarrow O \quad (4)$$

wherein $R_{12}$ is alkyl, alkenyl, or monohydroxy alkyl having a chain length of from 20 to 30 carbon atoms, and wherein $R_{13}$ and $R_{14}$ are each alkyl or monohydroxyl alkyl containing from 1 to 4 carbon atoms; particularly preferred are teritary phosphine oxides in which $R_{12}$ is alkyl, alkenyl, and monohydroxy alkyl having a chain length of from 20 to 36 carbon atoms, and wherein $R_{13}$ and $R_{14}$ are each methyl, ethyl or ethanol.

Specific examples include the following:
eicosyldimethylphosphine oxide,
eicosyldi(2-hydroxyethyl) phosphine oxide,
docosyldimethylphosphine oxide,
docosyldi(2-hydroxyethyl) phosphine oxide,
tetracosyldimethylphosphine oxide,
hexacosyldimethylphosphine oxide,
eicosyldiethylphosphine oxide,
docosyldiethylphosphine oxide, and
tetracosyldi(2-hydroxyethyl)phosphine oxide.

Examples of other tertiary phosphine oxides are:
eicosylmethylethylphosphine oxide,
heneicosyldimethylphosphine oxide,
β-hydroxyeicosyldimethylphosphine oxide,
β-hydroxydocosyldimethylphosphine oxide,
heneicosylmethylethylphosphine oxide,
docosylmethylethylphosphine oxide,
tricosyldiethylphosphine oxide,
tricosyldimethylphosphine oxide,
tetracosyldi(2-hydroxyethyl)phosphine oxide,
pentacosyldimethylphosphine oxide,
eicosylmethyl-2-hydroxybutylphosphine oxide,
eicosyldibutylphosphine oxide,
docosylmethyl-3-hydroxybutylphosphine oxide,
hexacosyldiethylphosphine oxide,
heptacosyldimethylphosphine oxide,
octacosyldiethylphosphine oxide, and
triacontyldimethylphosphine oxide.

Other nonionic tertiary phosphine oxides useful herein are known and include the nonionic synthetic detergents having the same formula as that of Formula 4 above wherein $R_{12}$ is an alkyl, alkenyl, or monohydroxyalkyl of from 10 to 20 carbon atoms, and wherein $R_{13}$ and $R_{14}$ are each alkyl or monohydroxyalkyl of from 1 to 3 carbon atoms.

Nonionic tertiary amine oxides are also useful as softening agents. These nonionic compounds have the formula.

$$R_{15}R_{16}R_{17}N\rightarrow O \quad (5)$$

wherein $R_{15}$ represents a straight or branched chain alkyl or alkenyl containing from 20 to 30 carbon atoms and from 0 to 2 hydroxyl substituents, from 0 to 5 ether linkages, there being at least one moiety of at least 20 carbon atoms containing no ether linkages, and 0 to 1 amide linkage, and wherein $R_{16}$ and $R_{17}$ are each alkyl or monohydroxyl alkyl groups containing from 1 to 4 carbon atoms and wherein $R_{16}$ and $R_{17}$ can be joined to form a heterocyclic group containing from 4 to 6 carbon atoms; particularly preferred are those wherein $R_{15}$ is a straight or branched alkyl, alkenyl or monohydroxy alkyl containing 20 to 26 carbon atoms and wherein $R_{16}$ and $R_{17}$ are each methyl, ethyl, or ethanol.

Specific examples of compounds are:
eicosyl-bis-(β-hydroxyethyl) amine oxide,
eicosyldimethylamine oxide,
docosyldimethylamine oxide,
docosyl-bis-(β-hydroxyethyl) amine oxide,
tetracosyldimethylamine oxide,
tetracosyl-bis-(β-hydroxyethyl) amine oxide,
hexacosyldimethylamine oxide, and
hexacosyl-bis-(β-hydroxyethyl) amine oxide.

Examples of other tertiary amine oxides are:
2-hydroxyeicosyldimethylamine oxide,
eicosylmethylethylamine oxide, eicosyldiethylamine oxide,
2-hydroxyeicosyldiethylamine oxide,
hencicosyldimethylamine oxide,
hencicosyldiethylamine oxide,
docosyldiethylamine oxide,
tricosyldimethylamine oxide,
tricosylidiethylamine oxide,
tetracosyldiethylamine oxide,
β-hydroxytetracosyldimethylamine oxide,
pentacosyldimethylamine oxide,
hexacosyldiethylamine oxide,
eicosylmethyl(2-hydroxypropyl) amine oxide,
docosylbutylmethylamine oxide,
2-docosenyldimethylamine oxide,
2-methoxydocosyldimethylamine oxide,
heptacosyldimethylamine oxide,
octacosylmethylethylamine oxide,
octacosyldiethylamine oxide,
nonacosyldimethylamine oxide,
triacontyldiethylamine oxide,
3;6-dioxaoctacosyldimethylamine oxide,
2-hydroxy-4-oxatetracosyldimethylamine oxide,
6-stearamidohexyldimethylamine oxide.

Other tertiary amine oxides useful herein are known and include compounds corresponding to Formula 5 above wherein $R_{15}$ is an alkyl of 8 to 20, particularly 16 to 18 carbon atoms, and $R_{16}$ and $R_{17}$ are methyl or ethyl radicals.

Nonionic ethoxylated alcohol compounds are also known as softening agents. These compounds have the generic formula $$R_{18}—O(C_2H_4O)_xH \quad (6)$$

wherein $R_{18}$ represents an alkyl of from 20 to 30 carbon atoms, and X is an integer of rom 3 to 45.

The ethoxylated alcohol compounds of this class are the condensation products of reacting from 3 moles to 45 moles of ethylene oxide with one mole of eicosyl alcohol, heneicosyl alcohol, tricosyl alcohol, tetracosyl alcohol, pentacosyl alcohol, or hexacosyl alcohol. Specific examples of the particularly preferred ethoxylated alcohols include the following reaction products of:

3 moles ethylene oxide + 1 mole of heneicosyl alcohol,
9 moles ethylene oxide + 1 mole eicosyl alcohol,
12 moles ethylene oxide + 1 mole hexacosyl alcohol,
15 moles of ethylene oxide + 1 moles tetracosyl alcohol,
20 moles of ethylene oxide + 1 mole pentacosyl alcohol, and
30 moles of ethylene oxide + 1 mole tricosyl alcohol.

Other ethoxylated alcohols are the condensation products of from 3 moles to 45 moles of ethylene oxide with one mole of heptacosyl, octacosyl, nonacosyl, or triacontyl alcohols. Specific examples include the condensation products of the following:

5 moles of ethylene oxide + 1 mole of nonacosyl alcohol,
6 moles of ethylene oxide and 1 mole of heptacosyl alcohol,
9 moles of ethylene oxide + 1 mole of octacosyl alcohol,
20 moles of ethylene oxide + 1 mole of heptacosyl alcohol,
30 moles of ethylene oxide + 1 mole of triacontyl alcohol, and
40 moles of ethylene oxide + 1 mole of nonacosyl alcohol.

Also suitable for use as softening agents are nonionic synthetic detergents as represented by the polyethylene oxide condensates of aliphatic alcohols containing from 8 to 20 carbon atoms and alkylphenols wherein the alkyl contains from 8 to 20 carbon atoms. Preferred ones are the condensation products of 1 mole of tallow alcohol with 20 moles and with 30 moles of ethylene oxide, hereinafter designated $TAE_{20}$ and $TAE_{30}$ respectively.

Also useful as softening agents are anionic ethoxylated alcohol sulfates and anionic sulfonates.

These ethoxylated alcohol sulfates have the generic formula $$R_{19}—O(C_2H_4O)_xSO_3—M+ \quad (7)$$

wherein X is an integer of from 1 to 20, M is an alkali metal (e.g., Na, K, Li), ammonium or substituted ammonium cations, and wherein $R_{19}$ is an alkyl containing from 20 to 30 carbon atoms.

The anionic ethoxylated alcohol sulfate softening compounds are the sodium and potassium salts or the monethanol, diethanol, or triethanol ammonium salts of the sulfated condensation product of from 1 to about 20 moles of ethylene oxide with one mole of eicosyl alcohol, heneicosyl alcohol, tricosyl alcohol, tetracosyl alcohol, pentacosyl alcohol, or hexacosyl alcohol. Specific examples of these particularly preferred anionic softening compounds include the salts of the sulfated condensation products of the following:

1 mole of ethylene oxide + 1 mole of tetracosyl alcohol,
3 moles of ethylene oxide + 1 mole of hexacosyl alcohol,
9 moles of ethylene oxide + 1 mole of tricosyl alcohol,
12 moles of ethylene oxide + 1 mole of eicosyl alcohol,
16 moles of ethylene oxide + 1 mole of pentacosyl alcohol, and
29 moles of ethylene oxide + 1 mole of heneicosyl alcohol.

Other anionic ethoxylated sulfate compounds are the sodium or potassium salts or monoethanol, diethanol, or triethanol ammonium cations of the sulfated condensation products of from 1 to 20 moles of ethylene oxide with one mole of heptacosyl alcohol, octacosyl alcohol, nonacosyl alcohol, and triacontyl alcohol.

Anionic synthetic detergents as represented by alkyl sulfates of the formula $$R_{20}—OSO_3—M+ \quad (8)$$

wherein M is an alkali metal and R is an alkyl of from 8 to 20 carbon atoms are also useful as softening agents herein. Anionic sulfates of the general formula are preferred:

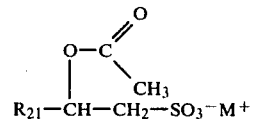

(9)

wherein M is an alkali metal or a substituted ammonium cation, and $R_{21}$ is an alkyl containing from 20 to 30 carbon atoms. The particularly preferred anionic sulfonates are those in which $R_{21}$ is an alkyl containing from 20 to 26 carbon atoms. Examples of compounds include:

sodium or potassium 2-acetoxydocosylsulfonate,
ammonium 2-acetoxydocosylsulfonate,
diethanolammonium 2-acetoxydocosylsulfonate,
sodium or potassium 2-acetoxytricosylsulfonate,
sodium or potassium 2-acetoxytetracosylsulfonate,
sodium or potassium 2-acetoxypentacosylsulfonate, sodium or potassium 2-acetoxyhexacosylsulfonate, sodium or potassium 2-acetoxyheptacosylsulfonate and sodium or potassium 2-acetoxyoctacosylsulfonate.

Other anionic sulfonates include sodium or potassium:

2-acetoxynonacosylsulfonate,
2-acetoxytriacontylsulfonate,
2-acetoxyheneitriacontylsulfonate, and
2-acetoxydotriacontylsulfonate.

Other anionic sulfonates useful as softening agents herein are the synthetic detergents as represented by, among others, sodium or potassium alkylbenzenesulfonates and sodium alkylglycerylethersulfonates having the configuration of Formula 9 above, wherein $R_{21}$ is an alkylbenzene or alkylglycerylether with the alkyl containing from 10 to 20 carbon atoms.

Additionally, ampholytic synethetic detergents of the formula $$R_{22}-\underset{\underset{A}{|}}{N}-(CH_2)_3-CH_2{}^{+}B^{-} \qquad (10)$$

wherein $R_{22}$ is an alkyl of from 8 to 18 carbon atoms. A is $R_{22}$ or hydrogen, and B is a water-solubilizing group (particularly $SO_3$—), can be used as softening agents.

The important criteria in selecting a fabric softening and/or antistatic agent is its ability to be powdered or granulated and that it have a softening point within the temperature range normally encountered in an automatic laundry dryer.

Preferred fabric softener and/or antistatic agents are quaternary ammonium salts alone or in combination with a compatible nonionic surfactant or other suitable quaternary ammonium salts meeting the above criteria.

According to one embodiment of the present invention, the fabric conditioning agent is a mixture of a quaternary ammonium salt and a nonionic surfactant in a ratio of 1:1 to 20:1, the mixture having a melting point in the range of 50° C.–100° C.

According to a further embodiment of the present invention, the fabric conditioning agent comprises a major proportion of a quaternary ammonium salt and a minor proportion of a nonionic surfactant.

According to another embodiment of the present invention, the fabric conditioning agent is an imidazoline or ethoxylated quaternary ammonium salt.

The ability of the fabric conditioning agent to be powdered or granulated is important so it can be dry blended with the remainder of the tablet mixture prior to tableting, and also to allow proper tablet breakdown in the dryer. In the dryer, the tablets of the present invention should possess the ability to rapidly break up from a distinct tablet to numerous small fragments, as a result of the mechanical forces from contact with the dryer drum and the dryer's contents, as the dryer rotates. These small pieces then distribute among the wet fabric bundle and are available to condition the fabrics when the softening point of the conditioning mixture is reached inside the dryer. A solid disc of fabric conditioning agent would typically exhibit a waxy nature and would not possess this ability to break up but would, instead, lead to severe staining of the fabric in the area of contact when its softening point was reached by the dryer's internal temperature.

The fabric conditioning agent is preferably a fabric softening agent, an antistatic agent, or both.

In order to tablet the powdered or granulated fabric conditioning agent, it must be blended with a suitable quantity of filler. The filler is necessary to increase the hardness of the final tableted product, and also to allow adequate tablet breakup by diluting the waxy particles of powdered conditioning mixture.

The only requirement for the filler is that it yield a hard, somewhat brittle tablet when used at an appropriate percentage of the tableting mixture, and not interfere with the tablet's disintegration. Thus, a simple salt, such as sodium chloride or sodium sulfate, is the preferred material. These are readily available commercially at acceptable particle sizes for direct compression tableting.

Anhydrous sodium sulfate supplied by Ozark-Mahoning, Tulsa, Oklahoma and Morton Salt's Star Flake Dendritic Salt, a sodium chloride salt from Morton Salt Division, in Chicago, Ill., are particularly useful.

A tablet binder/disintegrant is incorporated with the powdered fabric conditioning mixture and filler to provide sufficient cohesive properties necessary to form a firm, strong tablet under compression and secondly, to provide a means of tablet breakup auxilliary to the mechanical forces, by rapidly absorbing moisture under the hot/humid dryer conditions, thus swelling and aiding in the breakup. Without the moisture absorption, the binder would act against tablet breakup in the dryer rather than aiding it.

These materials are well known in the pharmaceutical industry. Some examples are: Avicel, the commercial name for microcrystalline cellulose from F.M.C., Philadelphia, Pa.; Amberlite IRP-88, a pharmaceutical grade ion exchange resin from Rohm and Haas, of Philadelphia, Pa.; and Explotab, the commercial name for a sodium starch glycolate available from Edward Mendell Company, Inc., Carmel, N.Y.

The addition of a small amount of lubricant to the product mixture before tableting is necessary to prevent the mix from binding and adhering to the punches and dies during tableting. The most effective and most commonly used lubricants in the pharmaceutical industry are metallic stearates; such are particularly useful in the present tablets. Both calcium and magnesium stearates are available from Witco Chemical, New York, N.Y. Other powdered lubricants such as talc and corn starch may also be substituted for metallic stearates.

Various other optional ingredients may be included in the present invention. Although these are not essential to the present invention, certain fabric treating additives may be included as desirable and useful. These include the addition of perfume, brightening agents, germicidal agents, and the like.

TABLETING

The tablet mix is formed by dry blending the powdered or granular fabric conditioning mixture with the filler, binder/disintegrant, and lubricant. The fabric conditioning mixture may compose from 15 to 60% of the tablet mix. This will vary dependent upon whether 1, 2, or up to 3 tablets will be used to condition a standard size bundle of fabrics. The filler will most commonly be in the range of from 20 to 80%. The binder/disintegrant material or combination of materials will range from 3 to 20% and the lubricant from 0.5 to 2%.

The weight of the final tablet compressed from the mix may range from 1 to B 3 grams in weight. The tablet diameter should be ¾ to 1½ inches. The pressure necessary to compress the mixture to a desirable tablet of suitable hardness and strength is optimally 5,000 lbs/in$^2$, but may vary from 2,000 to 7,500 lbs/in$^2$.

The following non-limitative examples more particularly illustrate the present invention:

EXAMPLE 1

The following powders were blended to form a tablet mix:

| | |
|---|---|
| 70 parts dimethyl ditallow ammonium chloride<br>30 parts glycerol monostearate | 55% |
| sodium sulfate | 35.5% |
| sodium starch glycolate binder | 4.0% |
| powdered cellulose | 4.0% |
| calcium stearate | 1.5% |

A Carver Laboratory Press, Model C, was then used to form 1⅛ in. diameter tablets of both 1.25 and 2.0 grams in weight, at pressures of 2,500 and 5,000 lbs/in. Softness testing was conducted using residential dryers with 5 pound mixed towel bundles and comparing 2×1.25 g. tablets, 1×2 g tablets (both tableted at 5,000 lbs/in$^2$), a conventional dryer-added fabric softener, and a no product control bundle. The towels conditioned with the tablets showed softening close to that obtained from the use of the conventional, sheet-type, dryer-added fabric softener. With a 5 lb bundle of synthetic fabrics, the tablets exhibited complete static elimination after a 50 minute drying cycle.

EXAMPLE 2

The following powders were blended to form a tablet mix:

| | |
|---|---|
| 70 parts dimethyl ditallow ammonium methylsulfate<br>30 parts glycerol monostearate | 30% |
| sodium sulfate | 60.5% |
| sodium starch glycolate binder | 4.0% |
| powdered cellulose | 4.0% |
| calcium stearate | 1.5% |

Two gram tablets were formed with a diameter of 1⅛ in., at a pressure of 5,000 lbs/in$^2$ following the procedure described in Example 1. One tablet was added to a wet 5 lb (dry weight) bundle of synthetic fabrics in a residential dryer. Upon drying to 50 minutes, the fabrics were devoid of any signs of static cling, while a control bundle, dried simultaneously, for the same time, had severe static. No tablet residue was found on any of the items of the bundle, or on the dryer drum itself. Small particles of the tablet's filler and presumably the remainder of the tablet, excluding any noticeable conditioning mixture, were detected mixed with the lint in the dryer's lint trap.

What is claimed is:

1. A tablet useful for conditioning fabrics during the drying cycle of an automatic laundry dryer which comprises a fabric conditioning amount of a powdered or granulated fabric conditioning agent having a softening point in the range of temperatures encountered in an automatic laundry dryer during the drying cycle, an amount of a suitable filler sufficient to achieve the desired degree of hardness of the tablet and also to allow adequate tablet breakup during use, an amount of binder/disintegrant sufficient to facilitate tableting of the conditioning mixture and disintegration of the tablet formed during use, and a small amount of lubricant sufficient to facilitate tableting.

2. A tablet according to claim 1 wherein the conditioning agent is a fabric softening agent.

3. A tablet according to claim 1 wherein the conditioning agent is a antistatic agent.

4. A tablet according to claim 1 wherein the conditioning agent is a fabric softening and antistatic agent.

5. A tablet according to claim 1 wherein the conditioning agent is a combination of a quaternary ammonium salt and a nonionic surfactant.

6. A tablet according to claim 5 wherein the ratio of the ammonium salt and nonionic surfactant is 1:1 to 20:1.

7. A tablet according to claim 5 wherein the conditioning mixture comprises a major proportion of the quaternary ammonium salt and a minor portion of nonionic surfactant.

8. A tablet according to claim 5 wherein the conditioning agent is a 70:30 blend of dimethyl ditallow ammonium methyl sulfate and glycerol monostearate.

9. A tablet according to claim 5 wherein the conditioning mixture comprises a 70:30 blend of dimethyl distearyl ammonium methyl sulfate and glycerol monostearate.

10. A tablet according to claim 1 wherein the agent is a quaternary ammonium salt.

11. A tablet according to claim 1 wherein the agent is an imidazolinium salt.

12. A tablet according to claim 1 wherein the agent is an ethoxylated quaternary ammonium salt.

13. A tablet according to claim 1 wherein the agent is a primary, secondary or tertiary amine.

14. A tablet according to claim 1 wherein the fabric conditioning agent comprises from 15% to 60% of the tablet by weight.

15. A tablet according to claim 1 which comprises 30% by weight of a 70:30 blend of dimethyl ditallow ammonium methyl sulfate and glycerol monostearate, 60.5% sodium sulfate, 4.0% sodium sulfate glycolate binder, 4.0% powdered cellulose, and 1.5% calcium stearate.

16. A tablet according to claim 1 which comprises 55% by weight of a 70:30 blend of dimethyl ditallow ammonium chloride and glycerol monostearate, 35% sodium sulfate, 4.0% phosphate dihydrate binder, 4.0% powdered cellulose and 1.5% calcium stearate.

17. A method of conditioning fabrics during the drying cycle of an automatic laundry which comprises placing in an automatic laundry dryer with the fabrics to be conditioned a tablet which comprises a fabric conditioning amount of a powdered or granulated fabric conditioning agent having a softening point in the range of temperatures encountered in an automatic laundry dryer during the drying cycle, an amount of a suitable filler sufficient to achieve the desired degree of hardness of the tablet and also to allow adequate tablet breakup during use, an amount of binder/disintegrant sufficient to facilitate tableting of the conditioning agent and disintegration of the tablet formed during use, and a small amount of lubricant sufficient to facilitate tableting.

18. A method according to claim 17 wherein the fabric conditioning agent comprises from 15% to 60%, of the tablet by weight.

19. A method according to claim 17 wherein the conditioning agent is a fabric softening agent.

20. A method according to claim 17 wherein the conditioning agent is an antistatic agent.

21. A method according to claim 17 wherein the conditioning agent is a fabric softening and an antistatic agent.

22. A method according to claim 17 wherein the conditioning agent is a quaternary ammonium salt and a nonionic surfactant in a ratio of 1:1 to 20:1.

23. A method according to claim 22 wherein the conditioning mixture comprises a major proportion of the quaternary ammonium salt and a minor portion of nonionic surfactant.

24. A method according to claim 22 wherein the conditioning mixture comprises a 70:30 blend of dimethyl ditallow ammonium methyl sulfate and glycerol monostearate.

25. A method according to claim 22 wherein the conditioning mixture comprises a 70:30 blend of dimethyl distearyl ammonium methyl sulphate and glycerol monostearate.

26. A method according to claim 17 wherein the melting point of the tablet's conditioning mixture is about 60° C.

27. A method according to claim 17 wherein the tablet comprises 55% by weight of a 70:30 blend of dimethyl ditallow ammonium chloride and glycerol monostearate, 35% sodium sulfate, 4.0% phosphate dihydrate binder, 4.0% powdered cellulose and 1.5% calcium stearate.

28. A method according to claim 17 wherein the tablet comprises 30% by weight of a 70:30 blend of dimethyl ditallow ammonium methyl sulfate and glycerol monostearate, 60.5% sodium sulfate, 4.0% sodium sulfate glycolate binder, 4.0% powdered cellulose, and 1.5% calcium stearate.

* * * * *